US010405100B2

(12) United States Patent
Fukuma et al.

(10) Patent No.: US 10,405,100 B2
(45) Date of Patent: Sep. 3, 2019

(54) SPEAKER APPARATUS THAT OSCILLATES AN OSCILLATING BODY VIA AN OSCILLATING ELEMENT

(71) Applicant: SONY CORPORATION, Tokyo (JP)

(72) Inventors: Yohei Fukuma, Chiba (JP); Kohei Kikuchi, Saitama (JP); Nobukazu Suzuki, Kanagawa (JP); Kazuhiro Matsutani, Chiba (JP); Yasuo Kawabata, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/533,695

(22) PCT Filed: Nov. 9, 2015

(86) PCT No.: PCT/JP2015/081484
§ 371 (c)(1),
(2) Date: Jun. 7, 2017

(87) PCT Pub. No.: WO2016/103930
PCT Pub. Date: Jun. 30, 2016

(65) Prior Publication Data

US 2017/0325031 A1 Nov. 9, 2017

(30) Foreign Application Priority Data

Dec. 26, 2014 (JP) ..... 2014-265425

(51) Int. Cl.
*H04R 1/02* (2006.01)
*H04R 1/24* (2006.01)
(Continued)

(52) U.S. Cl.
CPC ..... *H04R 17/00* (2013.01); *H04R 1/24* (2013.01); *H04R 1/403* (2013.01); *H04R 7/12* (2013.01);
(Continued)

(58) Field of Classification Search
CPC ..... H04R 1/24; H04R 15/00; H04R 17/00; H04R 7/12; H04R 9/00; H04R 9/02; H02K 33/02; F04B 49/06
See application file for complete search history.

(56) References Cited

U.S. PATENT DOCUMENTS 5,125,033 A * 6/1992 Lee ..... A61H 23/0236 381/151
5,321,763 A * 6/1994 Lee ..... A61H 23/0236 381/151
(Continued)

FOREIGN PATENT DOCUMENTS

CN 101500186 A 8/2009
CN 102469388 A 5/2012
(Continued)

OTHER PUBLICATIONS

International Search Report and Written Opinion of PCT Application No. PCT/JP2015/081484, dated Jan. 26, 2016, 02 pages of English Translation and 06 pages of ISRWO.

*Primary Examiner* — Fan S Tsang
*Assistant Examiner* — Angelica M McKinney
(74) *Attorney, Agent, or Firm* — Chip Law Group

(57) ABSTRACT

A sound conversion efficiency and a sound quality is improved. Included are an oscillating element that is expanded and contracted in response to a drive signal, two oscillating bodies that are positioned on opposite sides across the oscillating elements, have end faces arranged respectively in contact with both ends of the oscillating element in an expanding and contracting direction, and are oscillated by expansion and contraction of the oscillating element, and an urging spring that urges the two oscillating bodies and press the end faces against both the ends, respectively. Thus, the oscillating element is expanded and contracted, and the oscillating bodies are oscillated with the
(Continued)

end faces of the oscillating bodies urged by the urging spring being in contact with both the ends of the oscillating element in the expanding and contracting direction of the oscillating element.

8 Claims, 6 Drawing Sheets

(51) Int. Cl.

| | |
|---|---|
| ***H04R 1/40*** | (2006.01) |
| ***H04R 7/12*** | (2006.01) |
| ***F21V 33/00*** | (2006.01) |
| ***H04R 15/00*** | (2006.01) |
| ***H04R 17/00*** | (2006.01) |
| ***F21Y 105/18*** | (2016.01) |
| ***F21Y 115/10*** | (2016.01) |

(52) U.S. Cl.
CPC ..... *H04R 15/00* (2013.01); *F21V 33/0052* (2013.01); *F21Y 2105/18* (2016.08); *F21Y 2115/10* (2016.08); *H04R 1/02* (2013.01); *H04R 1/026* (2013.01)

(56) References Cited

U.S. PATENT DOCUMENTS

| | | | | |
|---|---|---|---|---|
| 2009/0175471 | A1* | 7/2009 | Suzuki | H04R 15/00 381/190 |
| 2010/0206767 | A1* | 8/2010 | Odashima | H01L 21/67353 206/710 |
| 2012/0063633 | A1* | 3/2012 | Suzuki | H04R 1/24 381/423 |
| 2012/0114150 | A1 | 5/2012 | Suzuki et al. | |
| 2013/0169071 | A1* | 7/2013 | Endo | H02K 33/02 310/25 |
| 2013/0331823 | A1* | 12/2013 | Askem | F04B 49/06 604/543 |

FOREIGN PATENT DOCUMENTS

| | | | |
|---|---|---|---|
| DE | 202010010538 | * | 9/2010 |
| EP | 2079251 | A2 | 7/2009 |
| EP | 2451191 | A2 | 5/2012 |
| JP | 4-127699 | A | 4/1992 |
| JP | 04-127699 | A | 4/1992 |
| JP | 2009-164991 | A | 7/2009 |
| JP | 4524700 | B2 | 8/2010 |
| JP | 2012-105021 | A | 5/2012 |
| RU | 2011144586 | A | 5/2013 |

* cited by examiner

SPEAKER APPARATUS THAT OSCILLATES AN OSCILLATING BODY VIA AN OSCILLATING ELEMENT

CROSS REFERENCE TO RELATED APPLICATIONS

This application is a U.S. National Phase of International Patent Application No. PCT/JP2015/081484 filed on Nov. 9, 2015, which claims priority benefit of Japanese Patent Application No. JP 2014-265425 filed in the Japan Patent Office on Dec. 26, 2014. Each of the above-referenced applications is hereby incorporated herein by reference in its entirety.

TECHNICAL FIELD

The present technology relates to a technical field of a speaker apparatus that oscillates an oscillating body by an oscillating element, which is expanded and contracted in response to a drive signal, and outputs a sound.

CITATION LIST

Patent Literature

Patent Literature 1: Japanese Patent No. 4524700

BACKGROUND ART

There are speaker apparatuses that output a sound (voice) having a predetermined frequency band. For example, one of the speaker apparatuses oscillates an oscillating body (sound diaphragm) by expansion and contraction of an oscillating element such as a piezoelectric element and a magnetostrictor, and outputs a sound (for example, see Patent Literature 1).

In the speaker apparatus described in Patent Literature 1, a driving signal is input to an oscillating element that functions as a driving part, the oscillating element is expanded and contracted, an oscillating body is oscillated by expansion and contraction of the oscillating element, and a sound is output.

In the speaker apparatus where the oscillating element is used as the driving part that oscillates the oscillating body, it is possible to obtain a great driving force and to ensure a good sound output state.

DISCLOSURE OF INVENTION

Technical Problem

Incidentally, in the speaker apparatus, in the case where a sound conversion efficiency is low when a drive signal is input to the driving part, a sound quality may be lowered. In particular, the oscillating element that oscillates the oscillating body is attached to a base part generally referred to as a "sound earth", and is expanded and contracted with respect to the sound earth. When a part of a drive force of the oscillating element is transmitted to the sound earth, the drive force may be decreased, and the sound conversion efficiency may be lowered.

It is an object of a speaker apparatus according to the present technology to overcome the above-described problems, and to increase the sound conversion efficiency and to improve the sound quality.

Solution to Problem

First, a speaker apparatus according to the present technology includes an oscillating element that is expanded and contracted in response to a drive signal, two oscillating bodies that are positioned on opposite sides across the oscillating element, have end faces arranged respectively in contact with both ends of the oscillating element in an expanding and contracting direction, and are oscillated by expansion and contraction of the oscillating element, and an urging spring that urges the two oscillating bodies and press the end faces against both the ends, respectively.

With this configuration, the oscillating element is expanded and contracted, and the two oscillating bodies are oscillated with the respective end faces of the oscillating bodies urged by the urging spring being in contact with both ends of the oscillating element in an expanding and contracting direction.

Second, in the above-described speaker apparatus, it is desirable that the oscillating body be formed into a tube shape, and a plurality of the oscillating elements be arranged separately in a circumferential direction of the oscillating bodies.

With this configuration, the oscillating bodies are oscillated stably by the plurality of the oscillating elements arranged separately in the circumferential direction.

Third, in the above-described speaker apparatus, it is desirable that a part of the urging spring have desirably a pair of elastic deformation portions that are formed into a biforked shape, and apply an urging force to the oscillating bodies, and the oscillating element be arranged between the pair of elastic deformation portions.

With this configuration, the elastic deformation portions are positioned on both sides of the oscillating element, and an equal urging force is applied to the end face of the oscillating body from the elastic deformation portions.

Fourth, in the above-described speaker apparatus, it is desirable that a flat spring be used as the urging spring, and a thickness direction of the urging spring be matched with the expanding and contracting direction.

With this configuration, an arrangement space for the urging spring becomes small in the expanding and contracting direction of the oscillating element.

Fifth, in the above-described speaker apparatus, it is desirable that a plurality of the urging springs be arranged separately in the circumferential direction of the oscillating bodies.

With this configuration, an equal force is applied to the end faces of the oscillating bodies in the circumferential direction from the urging spring.

Sixth, in the above-described speaker apparatus, it is desirable that a speaker unit that outputs a sound different from a sound output on the basis of oscillation of the oscillating bodies be arranged inside the oscillating bodies.

With this configuration, in the speaker apparatus, the plurality of different sounds are output.

Seventh, in the above-described speaker apparatus, it is desirable that lighting be arranged inside the oscillating bodies.

With this configuration, the speaker apparatus has not only a sound output function but also a lighting function.

Eighth, in the above-described speaker apparatus, it is desirable that a support arm be formed, the support arm being extending in a radial direction of the oscillating bodies, the urging spring being attached to the support arm, and wiring connected to the oscillating element be arranged inside the support arm.

With this configuration, an arrangement portion of the wiring is formed in the support arm that functions as an arrangement portion of the urging spring.

Advantageous Effects of Invention

According to the present technology, the oscillating elements are expanded and contracted, and the oscillating bodies are oscillated with the respective end faces of the two oscillating bodies urged by the urging springs being in contact with both the ends of the oscillating elements in the expanding and contracting direction. As a result, the sound conversion efficiency can be improved, and the sound quality can be improved.

It should be noted that the effects described in the present specification are merely illustrative and are not limitative, and may have additive effects.

BRIEF DESCRIPTION OF DRAWINGS

FIG. 6 is an enlarged cross-sectional view showing the urging spring, an oscillating element and the like.

MODE(S) FOR CARRYING OUT THE INVENTION

Hereinafter, embodiments of a speaker apparatus according to the present technology will be described with reference to the drawings.

A stationary type speaker apparatus is described below by way of example. Note that the speaker apparatus according to the present technology is applied without being limited to the stationary type speaker apparatus. For example, the speaker apparatus according to the present technology is widely applicable to a variety of other kinds of speaker apparatuses such as a hanging type speaker apparatus that is hung from a ceiling and the like.

It should be noted that the up-and-down, front-and-back, and left-and-right directions described below are for convenience of the description, and the present technology is applied without being limited to these directions.

<Configuration of Speaker Apparatus>

Figure 1:
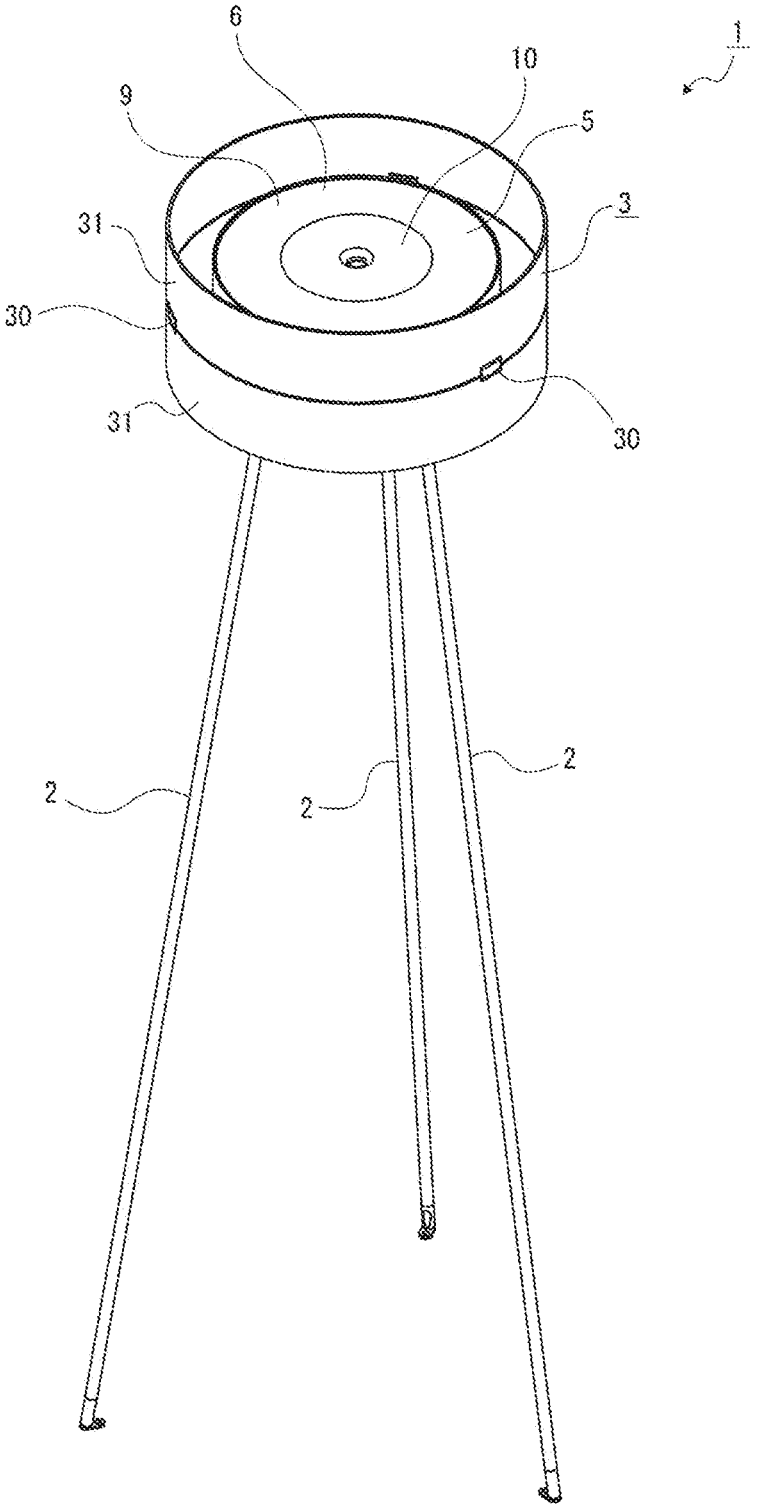
FIG. 1 shows an embodiment of a speaker apparatus according to the present technology together with FIG. 2 to FIG. 6, and is a perspective view of the speaker apparatus.

A speaker apparatus 1 includes stand legs 2, 2, and 2 installed on an installing surface such as a floor, and a main body 3 held by the stand legs 2, 2, and 2, the main body 3 being attached to the upper ends of the stand legs 2, 2, and 2 (see FIG. 1).

The stand legs 2 have stick shapes extending in the substantially up-and-down direction, and are positioned separately at equal intervals in the circumferential direction.

Figure 2:
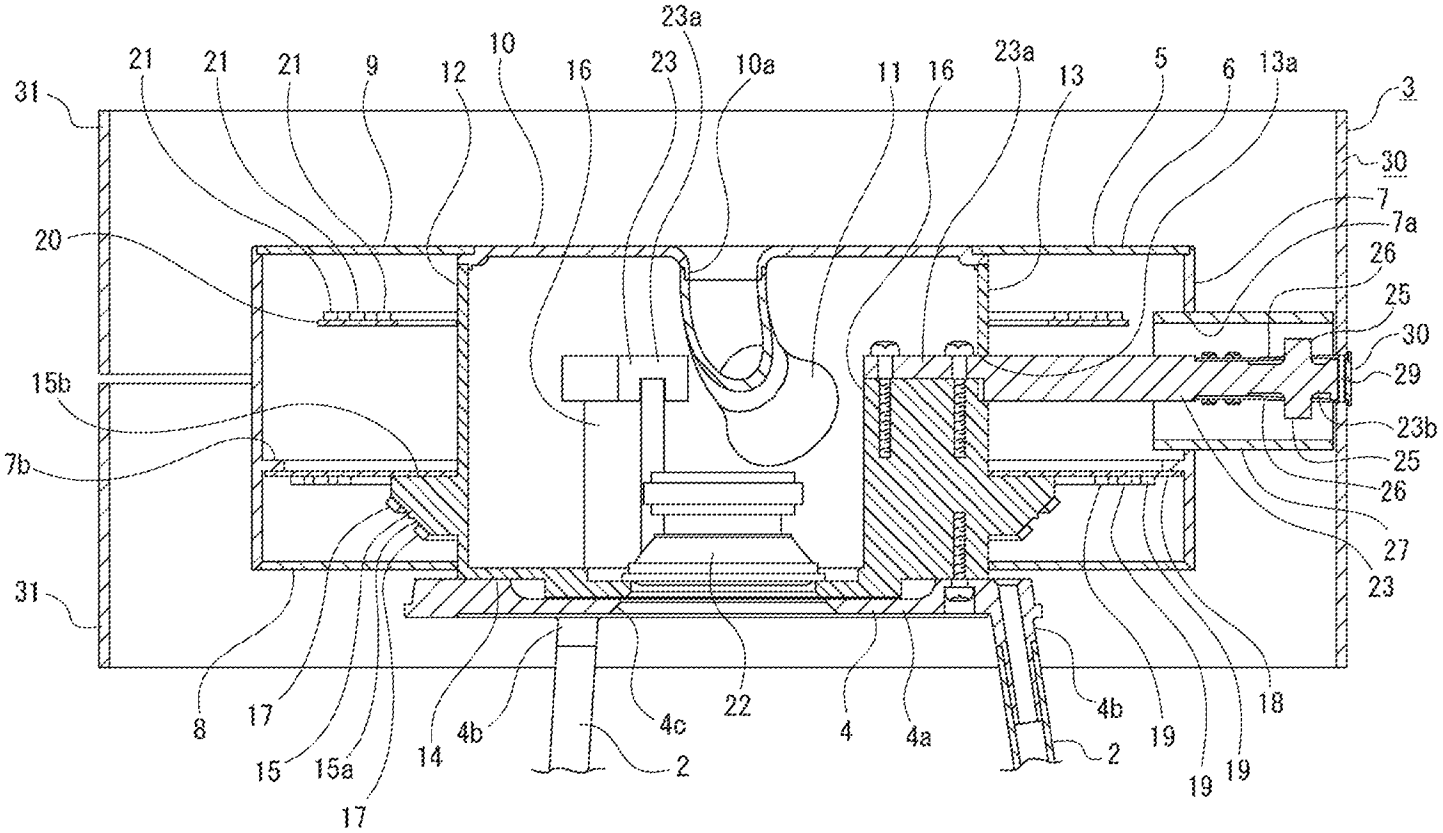
FIG. 2 is a cross-sectional view of the speaker apparatus by omitting a part thereof.
Figure 3:
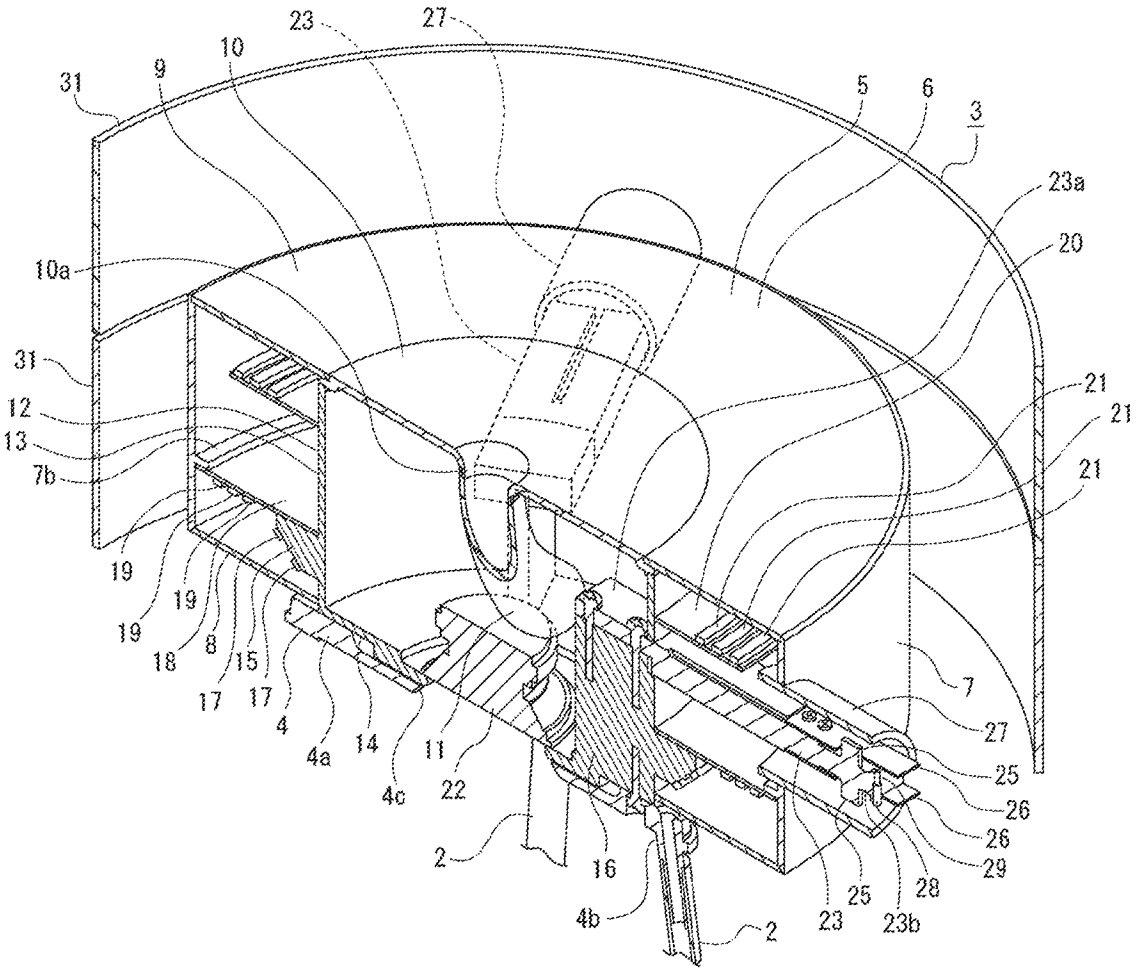
FIG. 3 is a cross-sectional view of the speaker apparatus by omitting a part thereof in a state different from that in FIG. 2.

The main body 3 has a base body 4, and a mechanism unit 5 attached to the base body 4 (see FIG. 2 and FIG. 3).

The base body 4 has a plate-like base member 4*a* facing in the up-and-down direction, and protrusions to be mounted 4*b*, 4*b*, and 4*b* that are protruded from the outer periphery of the base member 4*a* in the substantially downward direction. The protrusions to be mounted 4*b*, 4*b*, and 4*b* are mounted on upper ends of the stand legs 2, 2, and 2, respectively. The base member 4*a* has a substantially circular shape, and the center opening is formed as a sound output hole 4*c*.

Figure 4:
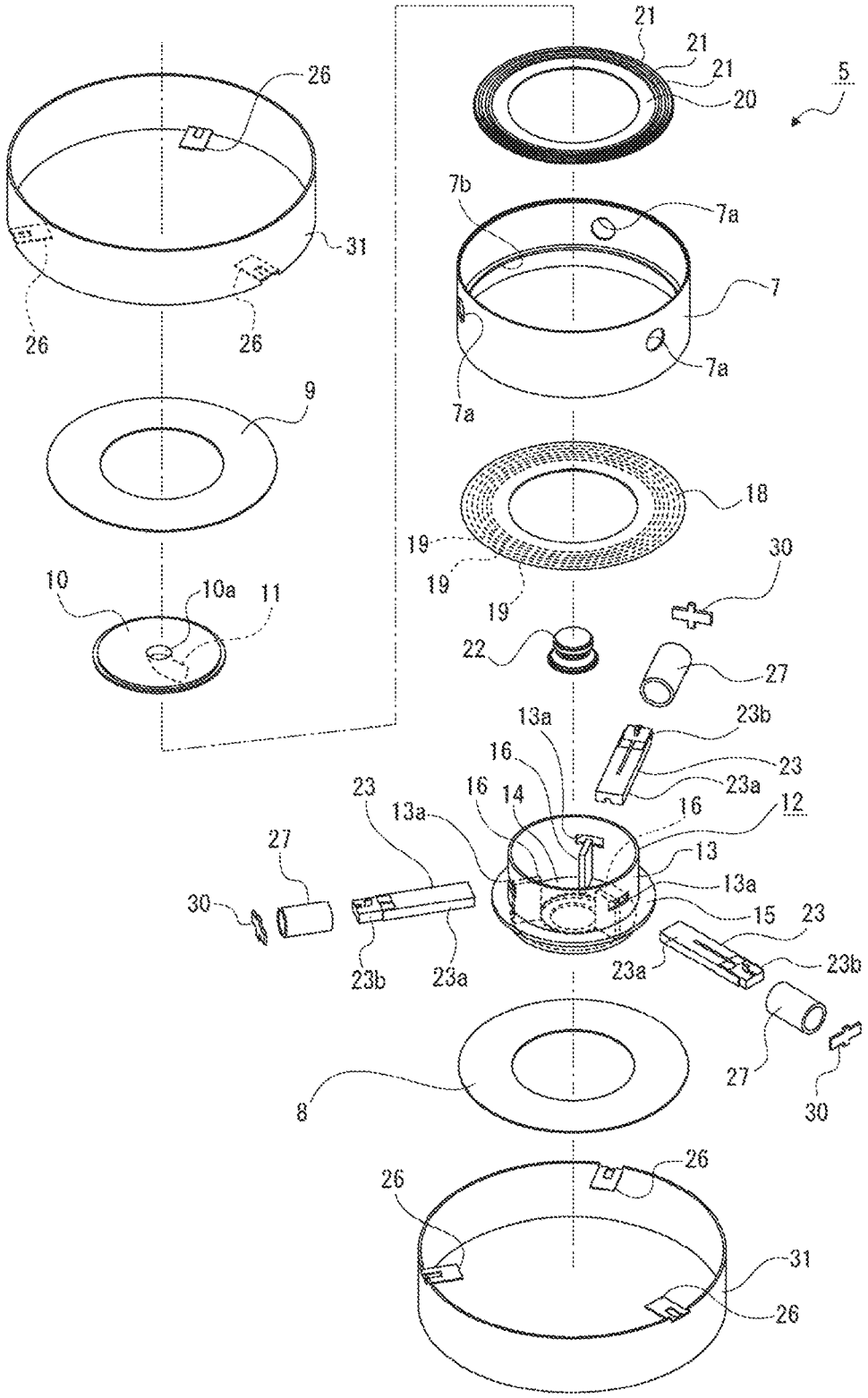
FIG. 4 is an exploded perspective view of the speaker apparatus by omitting a part thereof.

The mechanism unit 5 includes a housing 6, and necessary portions arranged in the housing 6 (see FIG. 2 to FIG. 4). At least a part of the housing 6 is formed of a transparent or translucent material, and includes a circular base 7 having a substantially hollow cylindrical shape extending in the up-and-down direction, a bottom base 8 attached to a lower end of the circular base 7, an upper base 9 attached to an upper end of the circular base 7, and a cover base 10 arranged inside the upper base 9.

The circular base 7 has pipe insertion holes 7*a*, 7*a*, and 7*a* formed separately at equal intervals in the circumferential direction. A flange-like ledge for mount 7*b* is formed extending inwardly at the center of the circular base 7 in the up-and-down direction.

The bottom base 8 has a circular shape, and includes an outer periphery attached to the lower end of the circular base 7. The upper base 9 has a circular shape, and includes an outer periphery attached to the upper end of the circular base 7. The cover base 10 has a circular outer shape, and includes an outer periphery attached to an inner periphery of the upper base 9 and a hollow cylindrical protrusion 10*a* protruded downwardly at the center.

A duct 11 is attached to the protrusion 10*a* of the cover base 10. The duct 11 is an output port on an upper side for a low pitch sound (voice) output from a speaker unit described later, and has a function to complement the low pitch sound output from the speaker unit.

In the housing 6, an arm holder 12 is arranged. The arm holder 12 includes a hollow cylindrical periphery 13 having an axial direction as the up-and-down direction, a circular shaped lower face part 14 continuous with the lower end of the periphery 13, a protrusion for arrangement 15 extending outwardly from a position near the lower end of the periphery 13, and pedestals for mount 16, 16, and 16 each of which is protruded upwardly from the lower face part 14.

In the arm holder 12, the upper end of the periphery 13 is attached to the outer periphery of the cover base 10, the lower end of the periphery 13 is attached to the inner periphery of the bottom base 8, and the lower face part 14 is attached, e.g., screwed, to the base member 4*a* of the base body 4.

The periphery 13 has arm insertion holes 13*a*, 13*a*, and 13*a* formed separately at equal intervals in the circumferential direction.

The pedestals for mount 16, 16, and 16 are formed separately at equal intervals in the circumferential direction, and outer ends are continuous with an inner face of the periphery 13. The upper face of the pedestal for mount 16 is positioned slightly higher than a lower edge of the arm insertion hole 13*a*.

The protrusion for arrangement 15 includes a tilted face 15*a* tilting downward and outward and a mounting face 15*b* facing upward. Circular light emitting elements 17 and 17 are attached to the tilted face 15*a* of the protrusion for arrangement 15. An inner periphery of a circular first substrate 18 is attached to the mounting face 15*b* of the protrusion for arrangement 15 from above.

An outer periphery of the first substrate 18 is attached to the ledge for mount 7*b* of the circular base 7 from below. Circular light emitting elements 19, 19, and 19 are mounted on the lower face in the outer periphery of the first substrate 18.

An inner periphery of a circular second substrate 20 is attached to the outer face of the periphery 13 at a position near the upper end. Circular light emitting elements 21, 21, and 21 are mounted on the upper face in the outer periphery of the second substrate 20.

Examples of the light emitting elements 17 and 17, the light emitting elements 19, 19, and 19, and the light emitting elements 21, 21, and 21 include a light emitting diode (LED), and the light emitting elements 17 and 17, the light emitting elements 19, 19, and 19, and the light emitting elements 21, 21, and 21 function as lighting. Light is emitted diagonally downward from the light emitting elements 17 and 17, light is emitted downwardly from the light emitting elements 19, 19, and 19, and light is emitted upwardly from the light emitting elements 21, 21, and 21. At least part of the emitted light is transmitted through the housing 6 formed of a transparent or translucent material.

A speaker unit 22 is attached to the center of the lower face part 14. The speaker unit 22 is, for example, a woofer, and has a function to output a low pitch sound. The speaker unit 22 is arranged so as to close the opening of the lower face part 14, and the outer periphery at the lower end is attached to the inner periphery of the lower face part 14.

Support arms 23, 23, and 23 are attached to the respective upper faces of the pedestals for mount 16, 16, and 16 of the arm holder 12.

Figure 5:
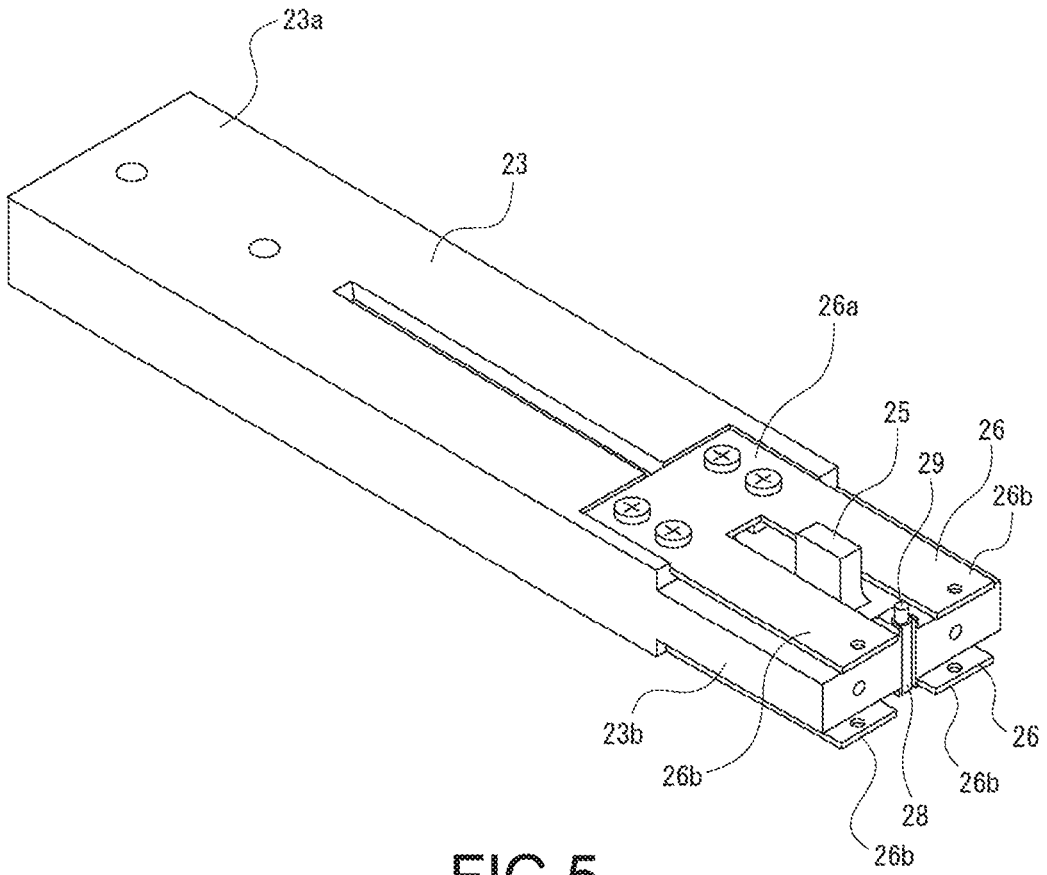
FIG. 5 is an enlarged perspective view showing a state that an urging spring is attached to a support arm.

The support arm 23 is formed into the shape extending in the radial direction of the arm holder 12 (see FIG. 4 and FIG. 5), and is inserted into the pipe insertion hole 7*a* of the circular base 7 and into the arm insertion hole 13*a* of the periphery 13 (see FIG. 2 and FIG. 3). In the support arm 23, a base end 23*a* being one end in the longitudinal direction is positioned inside the periphery 13 and attached, e.g., screwed, to the pedestal for mount 16, and a tip end 23*b* being the other end in the longitudinal direction is positioned outside the circular base 7.

Figure 6:
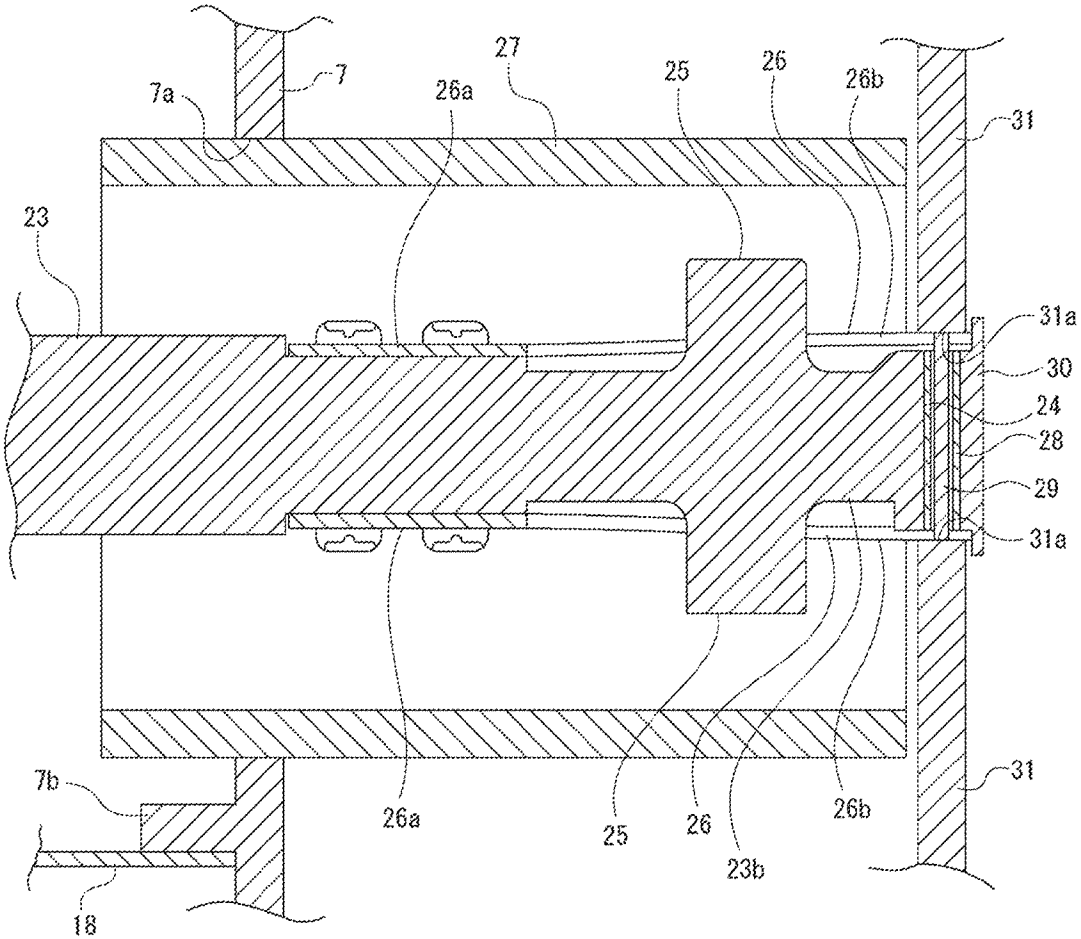

An element arrangement groove 24, which is penetrated through the tip end 23*b* in the up-and-down direction and is open outwardly, is formed in the support arm 23 (see FIG. 6). Protrusions 25 and 25 protruded in the up-and-down direction are formed near the tip of the support arm 23, and are positioned near the base end 23*a* relative to the element arrangement groove 24.

Each of urging springs 26 and 26 is attached to the support arm 23 near the base end 23*a* relative to the protrusions 25 and 25. For example, the urging spring 26 is a flat spring, is oriented in the up-and down direction, and has the shape extending in the same direction as the support arm 23 (see FIG. 5 and FIG. 6). The urging spring 26 has a face to be attached 26*a* at about one half in the longitudinal direction, and has biforked elastic deformation portions 26*b* and 26*b* at about the other half in the longitudinal direction.

The faces to be attached 26*a* and 26*a* of the urging springs 26 and 26 are attached, e.g., screwed, to both of upper and lower surfaces of the support arm 23. With the urging spring 26 being attached to the support arm 23, the protrusion 25 of the support arm 23 is at the position where the protrusion 25 is inserted between the elastic deformation portions 26*b* and 26*b*.

The tip end of the urging spring 26 is protruded outside the support arm 23.

The parts excluding a part of each of the support arms 23, 23, and 23 and the tip end of each of the urging springs 26, 26, . . . are covered with each of cover pipes 27, 27, and 27 circumferentially. The cover pipe 27 is formed into a hollow cylindrical shape having an axial direction being matched with the radial direction of the arm holder 12. The cover pipe 27 is attached to the circular base 7 such that a part of the cover pipe 27 is fitted and inserted into the pipe insertion hole 7*a* of the circular base 7.

Protection tubes 28, 28, and 28 are respectively inserted and arranged into the element arrangement grooves 24, 24, and 24 of the support arms 23, 23, and 23 (see FIG. 6). The protection tube 28 has an axial direction as the up-and-down direction, is formed of a resin material in a tube shape, and is arranged so as to fit into the element arrangement groove 24.

Oscillating elements 29, 29, and 29 are respectively inserted and arranged into the element arrangement grooves 24, 24, and 24 of the support arms 23, 23, and 23. For example, the oscillating element 29 is a laminated type piezoelectric element, is formed into a shape extending in the up-and-down direction, and is expanded and contracted in the up-and-down direction when a voltage (drive signal) is applied.

Lid members 30, 30, and 30 are respectively attached to the tip end surfaces of the support arms 23, 23, and 23. The lid member 30 covers the protection tube 28 and the oscillating element 29 arranged into the element arrangement groove 24.

The oscillating element 29 is arranged inside the protection tube 28 with a small gap. Thus, in the case where the oscillating element 29 is expanded and contracted, and expansion and contraction repeatedly occur in the radial direction, the oscillating element 29 is not in contact with the periphery of the element arrangement groove 24, and the oscillating element 29 is protected. Also, the protection tube 28 prevents the oscillating element 29 from leaning on the support arm 23.

It should be noted that the oscillating element 29 is not limited to the piezoelectric element, and may be any elements that are expanded and contracted, e.g., other element such as magnetostrictor.

Also, a space may be formed inside the support arm 23 having the element arrangement groove 24 where the oscillating element 29 is arranged, and the space may be formed as a space where wiring (not shown) is arranged to output a drive signal to the oscillating element 29.

Thus, since the wiring connected to the oscillating element 29 is arranged inside the support arm 23, an arrangement portion of the wiring is formed in the support arm 23 that functions as an arrangement portion of the urging spring 26. The arrangement portion of the urging spring 26 and the arrangement portion of the wiring are formed of the same member, whereby the number of components used in the speaker apparatus 1 can be reduced, and the speaker apparatus 1 can have a simplified structure and can be downsized.

The tip ends of the urging springs 26, 26, and 26 protruded outwardly from the cover pipes 27, 27, and 27 are attached to the oscillating bodies 31 and 31. The oscillating bodies 31 and 31 function as sound diaphragms, are formed of, e.g., acrylic resin in hollow cylindrical shapes each having an outside diameter greater than the circular base 7. The oscillating bodies 31 and 31 separated from each other in the up-and-down direction are positioned around the outer periphery of the circular base 7.

The tip ends of the urging springs 26, 26, and 26 attached to upper faces of the support arms 23, 23, and 23 are respectively attached, e.g., screwed, from below to a lower end face 31*a* of the oscillating body 31 positioned on the upper side. Thus, the oscillating body 31 positioned on the upper side is urged downwardly by the urging springs 26, 26, and 26.

The tip ends of the urging springs 26, 26, and 26 attached to lower faces of the support arms 23, 23, and 23 are respectively attached, e.g., screwed, from above to an upper end face 31*a* of the oscillating body 31 positioned on the lower side. Thus, the oscillating body 31 positioned on the lower side is urged upwardly by the urging springs 26, 26, and 26.

The lower end face 31*a* and the upper end face 31*a* of the oscillating bodies 31 and 31 are respectively positioned directly above the oscillating elements 29, 29, and 29. Thus, the end face 31*a* of the oscillating body 31 positioned on the upper side urged downwardly by the urging springs 26, 26, and 26 is pressed from above against the upper end faces of the oscillating elements 29, 29, and 29, and the end face 31*a* of the oscillating body 31 positioned on the lower side urged upwardly by the urging springs 26, 26, and 26 is pressed from below against the lower end faces of the oscillating elements 29, 29, and 29.

At this time, the oscillating element 29 is positioned in the state of being inserted between the elastic deformation portions 26*b* and 26*b* of the urging spring 26, and the elastic deformation portions 26*b* and 26*b* press the oscillating body 31 on both sides of the oscillating element 29.

Outside covers (not shown) having outer sizes larger than the lid members 30, 30, and 30 may be respectively attached to outer faces of the lid members 30, 30, and 30.

<Operation of Speaker Apparatus>

In the speaker apparatus 1 configured as described above, in the case where a drive signal is input from a drive circuit (not shown) to the oscillating elements 29, 29, and 29, the oscillating elements 29, 29, and 29 are expanded and contracted in the up-and-down direction in response to the input drive signal, and the oscillating bodies 31 and 31 pressed against the oscillating elements 29, 29, and 29 are oscillated. In the case where the oscillating bodies 31 and 31 are oscillated, a mid to high pitch sound is output. Thus, the oscillating bodies 31 and 31 function as sound diaphragms of a tweeter.

In the speaker apparatus 1, since the oscillating bodies 31 and 31 are formed into the tube shape, and a plurality of the oscillating elements 29, 29, and 29 are arranged separately in the circumferential direction of the oscillating bodies 31 and 31, the above-described oscillating bodies 31 and 31 are oscillated stably by the plurality of the oscillating elements 29, 29, and 29 arranged separately in the circumferential direction. Thus, the sound quality can be improved.

In addition, since a pair of the biforked elastic deformation portions 26*b* and 26*b* are formed in the urging spring 26, and the oscillating element 29 is positioned between the elastic deformation portions 26*b* and 26*b*, the elastic deformation portions 26*b* and 26*b* are positioned on both sides of the oscillating element 29.

Thus, an equal urging force is applied to the end face 31*a* of the oscillating body 31 from the elastic deformation portions 26*b* and 26*b*, the oscillating body 31 is pressed stably against the oscillating element 29, and a stable oscillation state of the oscillating body 31 can be ensured.

Furthermore, since the plurality of the urging springs 26, 26, . . . are arranged separately in the circumferential direction, an equal force is applied to the end faces 31*a* and 31*a* of the oscillating bodies 31 and 31 in the circumferential direction from the urging springs 26, 26, . . . , the oscillating bodies 31 and 31 are more stably pressed against the oscillating elements 29, 29, and 29, and the more stable oscillation state of the oscillating bodies 31 and 31 can be ensured.

Meanwhile, the low pitch sound is output from the speaker unit 22 that functions as a woofer arranged inside the oscillating bodies 31 and 31, as described above. The sound is output from the speaker unit 22 through the sound output hole 4*c* formed on the base member 4*a* of the base body 4 and the duct 11.

Thus, in the speaker apparatus 1, the speaker unit 22 that outputs a sound different from the sound output on the basis of the oscillation of the oscillating bodies 31 and 31 is arranged inside the oscillating bodies 31 and 31.

In this manner, since the plurality of different sounds are output, the functionality of the speaker apparatus 1 can be improved, and since the arrangement space for the speaker unit 22 is present inside the oscillating bodies 31 and 31, the speaker apparatus 1 can be downsized.

<Conclusion>

As described above, the speaker apparatus 1 includes the oscillating elements 29, 29, and 29 that are expanded and contracted in response to the drive signal, the oscillating bodies 31 and 31 positioned on opposite sides across the oscillating elements 29, 29, and 29 and having the end faces 31*a*, 31*a* arranged in contact with both ends of the oscillating elements 29, 29, and 29 in the expanding and contracting direction, and the urging springs 26, 26, . . . that urge the oscillating bodies 31 and 31 and press the end faces 31*a* and 31*a* against both ends of the oscillating elements 29, 29, and 29, respectively.

Thus, the oscillating elements 29, 29, and 29 are expanded and contracted, and the oscillating bodies 31 and 31 are oscillated with the end faces 31*a*, 31*a* of the oscillating bodies 31 and 31 urged by the urging springs 26, 26, . . . being in contact with both ends of the oscillating elements 29, 29, and 29 in the expanding and contracting direction.

In this manner, since the oscillating elements 29, 29, and 29 are not attached to a base part referred to as a sound earth, and no sound earth of the oscillating elements 29, 29, and 29 is present, there are no defects that a part of the drive force of the oscillating elements 29, 29, and 29 is transmitted to the sound earth, thereby decreasing the drive force, the sound conversion efficiency can be improved, and the sound quality can be improved.

In addition, since a sound is output at the same time from the oscillating bodies 31 and 31 that function as the sound diaphragms, while the high sound conversion efficiency is ensured, a sound pressure can be improved, a regeneration band can be widened, and the sound output direction can be multidirectionally oriented.

Furthermore, since no heavy sound earth is typically present, the weight of the speaker apparatus 1 is reduced, and the speaker apparatus 1 can be light-weighted.

It should be noted that the size and the material of the oscillating bodies 31 and 31 can be selected arbitrarily as long as the oscillation occurs by expansion and contraction of the oscillating elements 29, 29, and 29. It is possible to adjust the frequency and the output direction of the sound as necessary by the change of the size or the material of the oscillating bodies 31 and 31. Thus, a degree of design freedom in the speaker apparatus 1 can be improved.

Also, it is possible to adjust the frequency and the sound pressure about the output sound by the adjustment of the urging force of the urging spring 26 to the oscillating bodies 31 and 31. It is also possible to improve the degree of design freedom in the speaker apparatus 1 by the adjustment of the urging force of the urging spring 26 to the oscillating bodies 31 and 31.

Further, since the flat spring is used as the urging spring 26, and the thickness direction of the urging spring 26 is matched with the expanding and contracting direction of the oscillating element 29, the arrangement space for the urging spring 26 becomes small in the expanding and contracting direction of the oscillating element 29, and the speaker apparatus 1 can be downsized.

Furthermore, since the light emitting elements 17, 17, 19, 19, 19, 21, 21, and 21 that function as lighting are arranged inside the oscillating bodies 31 and 31 in the speaker apparatus 1, the speaker apparatus 1 has not only the sound output function but also the lighting function, and the functionality of the speaker apparatus 1 can be improved.

<Others>

Although the six urging springs 26 and the three oscillating elements 29 are arranged in the above by way of example, the numbers of the urging springs 26 and the oscillating elements 29 are not limited to six and three, respectively, and may be arbitrary.

Also, although the urging springs 26 and the oscillating elements 29 are positioned separately at equal intervals in the circumferential direction in the above by way of example, arrangement positions of the urging springs 26 and the oscillating elements 29 are arbitrary.

It should be noted that in the case where the speaker apparatus 1 is of a hanging type, no stand legs 2, 2, and 2 are necessary. For example, a cable may be connected to the mechanism unit 5, and the speaker apparatus 1 may be hung from a ceiling or the like.

In addition, a flange unit may be provided at the upper end or the lower end of the oscillating body 31, the flange unit may be connected to the elastic deformation portions 26*b* and 26*b* of the urging spring 26, or the flange unit may come in contact with the oscillating element 29, whereby the oscillation occurs by expansion and contraction of the oscillating element 29.

<Present Technology>

The present technology may have the following configurations.

(1) A speaker apparatus, including:

an oscillating element that is expanded and contracted in response to a drive signal;

two oscillating bodies that are positioned on opposite sides across the oscillating element, have end faces arranged respectively in contact with both ends of the oscillating element in an expanding and contracting direction, and are oscillated by expansion and contraction of the oscillating element; and an urging spring that urges the two oscillating bodies and press the end faces against both the ends, respectively.

(2) The speaker apparatus according to (1), in which the oscillating body is formed into a tube shape, and a plurality of the oscillating elements are arranged separately in a circumferential direction of the oscillating bodies.

(3) The speaker apparatus according to (1) or (2), in which a part of the urging spring has a pair of elastic deformation portions that are formed into a biforked shape, and apply an urging force to the oscillating bodies, and the oscillating element is arranged between the pair of elastic deformation portions.

(4) The speaker apparatus according to any of (1) to (3), in which a flat spring is used as the urging spring, and a thickness direction of the urging spring is matched with the expanding and contracting direction.

(5) The speaker apparatus according to any of (1) to (4), in which a plurality of the urging springs are arranged separately in the circumferential direction of the oscillating bodies.

(6) The speaker apparatus according to any of (2) to (5), in which a speaker unit that outputs a sound different from a sound output on the basis of oscillation of the oscillating bodies is arranged inside the oscillating bodies.

(7) The speaker apparatus according to any of (2) to (6), in which lighting is arranged inside the oscillating bodies.

(8) The speaker apparatus according to any of (2) to (7), in which a support arm is formed, the support arm being extending in a radial direction of the oscillating bodies, the urging spring being attached to the support arm, and wiring connected to the oscillating element is arranged inside the support arm.

REFERENCE SIGNS LIST

1 speaker apparatus
17 light emitting element (lighting)
19 light emitting element (lighting)
21 light emitting element (lighting)
22 speaker unit
23 support arm
26 urging spring
26*b* elastic deformation portion
29 oscillating element
31 oscillating body
31*a* end face

The invention claimed is:

1. A speaker apparatus, comprising:

an oscillating element configured to expand and contract based on a drive signal;

a first oscillating body having a first side in contact with a first side of the oscillating element;

a second oscillating body having a first side in contact with a second side of the oscillating element, wherein the first oscillating body and the second oscillating body are configured to oscillate based on the expansion and the contraction of the oscillating element;

a first urging spring connected to the first side of the first oscillating body; and a second urging spring connected to the first side of the second oscillating body, wherein the first urging spring and the second urging spring are configured to oscillate the first oscillating body and the second oscillating body in opposite directions, each of a part of the first urging spring and a part of the second urging spring includes a pair of elastic deformation portions, and the oscillating element is in between the pair of elastic deformation portions.

2. The speaker apparatus according to claim 1, further comprising:

a plurality of oscillating elements in a circumferential direction of the first oscillating body and the second oscillating body, wherein the plurality of oscillating elements include the oscillating element, and each of the first oscillating body and the second oscillating body is of tube shape.

3. The speaker apparatus according to claim 2, further comprising a plurality of urging springs in the circumferential direction of the first oscillating body and the second oscillating body, wherein the plurality of urging springs include the first urging spring and the second urging spring.

4. The speaker apparatus according to claim 2, further comprising a speaker unit configured to output a first sound different from a second sound, wherein the second sound is output based on the oscillation of the first oscillating body and the second oscillating body, and the speaker unit is inside the first oscillating body and the second oscillating body.

5. The speaker apparatus according to claim 2, further comprising a lighting emitting element inside the first oscillating body and the second oscillating body.

6. The speaker apparatus according to claim 2, further comprising a support arm, wherein the support arm extends in a radial direction of the first oscillating body and the second oscillating body, the first urging spring is attached to the support arm, and a wiring connected to the oscillating element is inside the support arm.

7. The speaker apparatus according to claim 1, wherein the pair of elastic deformation portions is in a biforked shape, and is configured to force the first oscillating body.

8. The speaker apparatus according to claim 1, wherein the first urging spring is a flat spring, and a thickness direction of the first urging spring is matched with an expanding and contracting direction.

* * * * *